US005494242A

United States Patent [19]

Ludwick et al.

[11] Patent Number: 5,494,242

[45] Date of Patent: Feb. 27, 1996

[54] LOW PROFILE SWITCH MACHINE WITH HAND THROW OR MOTOR THROW SELECTOR DEVICE

[75] Inventors: George E. Ludwick, Tequesta; Keith J. Gordon, West Palm Beach, both of Fla.; Charles M. Eggebrecht, Churchville, N.Y.

[73] Assignee: General Railway Signal Corporation, Rochester, N.Y.

[21] Appl. No.: 293,121

[22] Filed: Aug. 19, 1994

[51] Int. Cl.[6] ..... E01B 7/00

[52] U.S. Cl. ..... 246/393; 246/406; 246/407; 74/665 B; 74/405

[58] Field of Search ..... 246/393, 405, 246/406, 407, 410, 412; 74/665 R, 665 B, 665 A, 670, 405, 406

[56] References Cited

U.S. PATENT DOCUMENTS

| | | | |
|---|---|---|---|
| 2,311,010 | 2/1943 | Vickers | 74/665 B |
| 2,707,230 | 4/1955 | Beltman et al. | 246/393 |
| 2,724,289 | 11/1955 | Wight | 74/405 |
| 3,418,462 | 12/1968 | Wilson et al. | 246/393 |
| 3,691,371 | 9/1972 | Hylen | 246/393 |

*Primary Examiner*—Robert J. Oberleitner
*Assistant Examiner*—S. Joseph Morano
*Attorney, Agent, or Firm*—Ohlandt, Greeley, Ruggiero & Perle

[57] ABSTRACT

A switch machine for railroad tracks is provided having a low vertical profile without increasing the axial length of existing switch machines. Also, the capability of being operated by an electric motor, hand crank or hand throw operation has been retained within these new dimensional constraints. A particular electric motor and gearbox combination permits a low overall profile due to its compact size. A worm gear shaft serves the dual purpose of driving a worm wheel and coupling to a hand crank, thus maintaining the low profile while increasing the functionality of the shaft. In addition, a hand throw drive shaft is provided adjacent to a crank drive shaft in order to provide a hand throw operation while further maintaining the low profile of the switch machine.

13 Claims, 8 Drawing Sheets

LOW PROFILE SWITCH MACHINE WITH HAND THROW OR MOTOR THROW SELECTOR DEVICE

RELATED APPLICATIONS

Reference is made to United States applications titled POINT DETECTION AND INDICATION WITH LATCH OUT MEANS (U.S. application Ser. No. 08/293,126) and SWITCH MACHINE CAM BAR (U.S. application Ser. No. 08/293,127) that relate to art similar to the present application and are commonly owned by the applicant.

BACKGROUND OF THE INVENTION

I. Field of the Invention

The present invention relates generally to switch devices for switching the positions of railway tracks in order for trains to move from one track to another. More particularly, the present invention relates to an electric motor driven switch machine having a low vertical profile while retaining all of the functionality of existing switch machines.

II. Description of the Prior Art

It is a requirement for operation of a railroad network to have the capability of switching railroad trains from one track to another. A common method of providing this switching capability is to install an electric motor driven switch machine along side of, and interconnected to, a switch point of a railroad track. These switch machines often have one or more manual operations for shifting the position of the track without the use of the electric motor for certain situations, such as when electric power is not available.

Two manual operations typically integrated within switch machines are the hand crank and hand throw operations. The hand crank operation permits operational personnel to switch the track at the switch point by turning a hand crank for maintenance and installation purposes. The hand throw operation permits operational personnel to switch the track, i.e., throw the switch machine, at the switch machine when control signals from a remote control facility are not able to reach the switch machine.

Conventional design practice has been to place a hand throw means for controlling the hand throw operation above one of the drive shafts of the switch machine, such as the crank shaft. This practice not only creates an undesirable bump in the top profile of the machine, but also contributes to the high vertical profile of existing switch machines.

A switch machine having a low vertical profile and no projections extending from its top surface is desirable for many applications. Particularly for transit applications, it is essential that a low profile be maintained by a switch machine in order to clear steps, third rail electric pick-ups and other types of ground clearing equipment extending down from a transit car or locomotive.

A low profile switch without overhead projections is also desirable for additional safety and maintenance reasons. The switch machine is subject to all manner of damage due to its harsh environment. For example, vehicles or objects that may contact and damage the switch machine include rail maintenance equipment, snow removal means, foreign objects falling off trains, local car and truck traffic in the area and other objects passing through or over the general vicinity of the switch machine.

There are known in the art switch machines that are submersed within pits or covered with protective structures. These switch machine designs lower the vertical profile and provide added protection to the switch machines, however, require a longer axial length and are difficult to install within the ground layouts of existing switch machines.

Accordingly, it is a primary object of the present invention to overcome the aforenoted problem associated with designing a switch machine having a low vertical profile while retaining all of the various capabilities of existing switch machines, including the electric motor, hand crank and hand throw operations.

Another object is to provide an additional vertical shaft for the hand throw operation that is independent of, and horizontally adjacent to, any other vertical shaft of the switch machine, in order to reduce the height of the switch machine.

An additional object is to provide a switch machine having no projections extending from its top surface in order to clear various types of ground clearing equipment extending down from passing vehicles.

A further object is to provide a switch machine disposed or situated within the confines of the ground layouts of existing switch machines in order to facilitate the installation of the switch machine within existing railroad networks.

A still further object is to provide a switch machine having a low vertical profile for safety in order to avoid various hazards that pass through its general vicinity, without the need of an additional protective cover.

SUMMARY OF THE INVENTION

In fulfillment of the above stated and other objects, the problem noted above has been overcome by designing a switch machine for railroad tracks with many new improvements. One improvement is a electric motor and gearbox combination that permits a low overall profile due to its compact size. Another improvement is a worm gear shaft that drives a drive gear and couples to a hand crank, thus maintaining the low profile while serving a dual function. Yet another improvement is a hand throw drive shaft that is adjacent to a crank drive shaft in order to provide a hand throw operation while further maintaining the low profile of the switch machine.

Briefly described then, a preferred embodiment of the present invention is defined as follows. A low vertical profile switch machine for switching a position of a railroad track having a mode selector for selecting among a plurality of modes including a power mode and a hand throw mode, comprising: a crank shaft, a crank gear freely rotatable about the crank shaft, a crank sleeve slidably mounted about the crank shaft for engaging the crank gear to the crank shaft, a hand throw shaft positioned adjacent and substantially parallel to the crank shaft, a bevel gear freely rotatable about the hand throw shaft, a hand throw assembly slidably mounted about the hand throw shaft for engaging the bevel gear to the hand throw shaft; and a shifter mechanism, having a first end connected to the crank sleeve and a second end connected to the hand throw assembly, for shifting the first and second ends based on the mode selected by the mode selector; wherein the shifter mechanism shifts the first end to engage the crank gear and the second end to disengage the bevel gear when the power mode is selected by the mode selector, and wherein the shifter mechanism shifts the second end to engage the bevel gear and disengage the crank gear when the hand throw mode is selected by the mode selector.

The preferred embodiment of the present invention is also provided as follows. A low vertical profile switch machine for switching a position of a railroad track having a mode selector for selecting among a plurality of modes including a power mode and a hand throw mode, comprising: a motor, a first gearbox driven by the motor having an input shaft and an output shaft each adapted to rotate, wherein the rotational speed of the input shaft is proportional to the rotational speed of the output shaft, a gear shaft assembly including a gear shaft having a first input end and a second input end opposite the first input end, wherein the output shaft is coupled to the first input end, a hand crank means for driving the gear shaft removably attached to the second input end, a crank shaft positioned a fixed distance from the gear shaft assembly, a crank gear freely rotatable about the crank shaft and driven by the gear shaft assembly, a crank sleeve slidably mounted about the crank shaft for engaging the crank gear to the crank shaft, a hand throw shaft positioned adjacent and substantially parallel to the crank shaft, a bevel gear freely rotatable about the hand throw shaft, a hand throw assembly slidably mounted about the hand throw shaft for engaging the bevel gear to the hand throw shaft; and a shifter mechanism, having a first end connected to the crank sleeve and a second end connected to the hand throw assembly, for shifting the first and second ends based on the mode selected by the mode selector, wherein the shifter mechanism shifts the first end to engage the crank gear and the second end to disengage the bevel gear when the power mode is selected by the mode selector, and the shifter mechanism shifts the second end to engage the bevel gear and disengage the crank gear when the hand throw mode is selected by the mode selector.

Other and further objects, features and advantages of the present invention will be understood by reference to the following description in conjunction with the annexed drawings, wherein like parts have been given like numbers.

DETAILED DESCRIPTION OF THE PREFERRED EMBODIMENT

Figure 1:
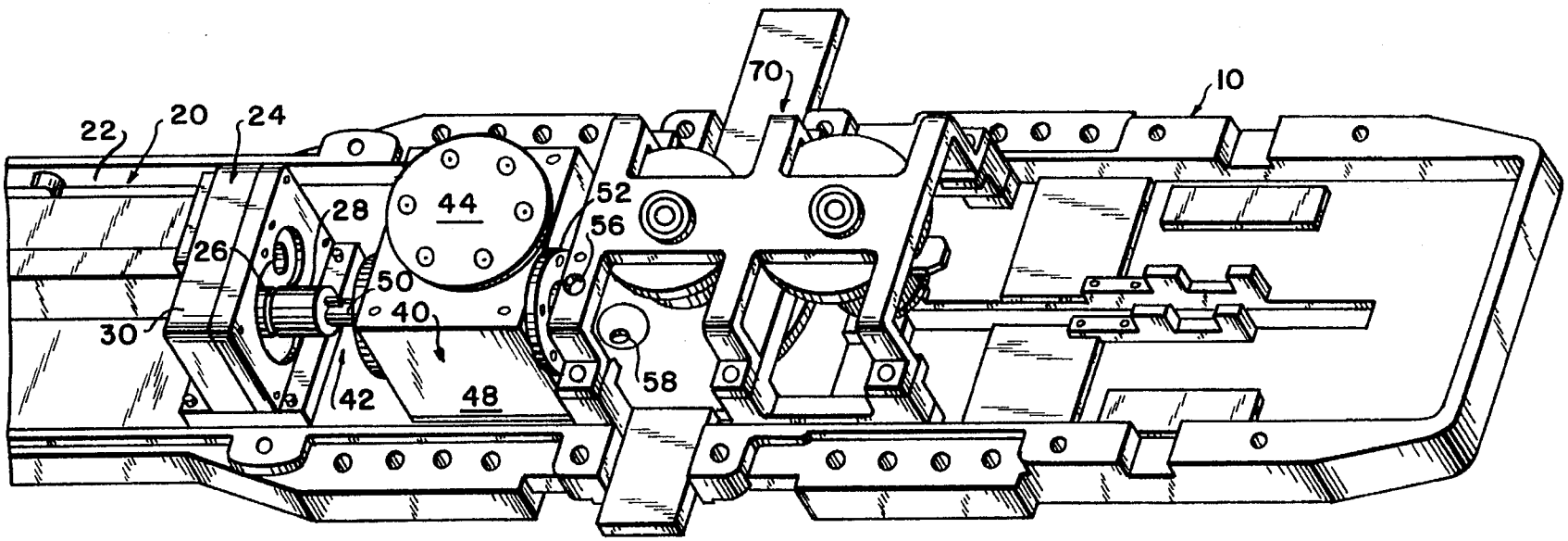
FIG. 1 is a perspective view of the base of the preferred embodiment of the present invention along with the main components of the preferred embodiment.

Referring to the drawings and, in particular, FIG. 1, there is generally provided a electric motor driven switch machine 10 of the present invention, having a low vertical profile. FIG. 1 is a partial cut-away view of the main components of the preferred embodiment, whereby the cover 12, shown in FIG. 3, of the switch machine has been removed and certain other components have been omitted. Although these other components may be essential for the full operation of the switch machine, they are not considered to be essential for the low vertical profile feature of the preferred embodiment and have been omitted from FIGS. 1 through 8 in order to more clearly identify the various components of the present invention without obstruction. All components omitted from FIGS. 1 through 8 are considered to have acceptable low profile equivalents available in the prior art, and thus, do not require detailed descriptions.

In order to lower the vertical height while keeping within all other dimensions of existing switch machines, the following novel means of packaging the various components has been developed. As shown in FIG. 1, viewed from left to right, the main components of the preferred embodiment comprise a motor-gearbox combination 20, worm drive gearbox 40 and crank-hand throw drive combination 70.

The motor-gearbox combination 20 comprises a motor 22, such as a brushless D.C. motor, that drives a speed reducer gearbox 24. An output shaft 26 extending from the side of the speed reducer gearbox 24 opposite the motor 22 rotates at a speed that is less than, and proportional to, the speed of the motor. This motor-gearbox combination 20 permits a low profile in that the motor 22 is very compact compared to other switch machine concepts in existence. Without the use of the speed reducer gearbox 24, a motor having a much larger diameter would be required.

The worm drive gearbox 40 has a worm gear shaft 42 that is driven by the output shaft 26 of the motor 22 through a coupling 28. The worm gear shaft 42 drives a worm wheel 44 that is on the first of three vertical shafts, the worm drive shaft 46, shown in FIGS. 2 and 3 and described subsequently. The worm gear shaft 42 extends through the outer cover 48 of the worm drive gearbox 40 such that the ends 50, 52 of the worm gear shaft are positioned outside of the outer cover. As stated above, one end 50 of the worm gear shaft is driven by the output shaft 26 of the motor 22. The other end 52 of the worm gear shaft 42 is driven by a hand crank means 54 (shown in FIG. 8) that is removably positioned within a hand crank hole 56 and a hand crank socket 58 so that the hand crank means engages the worm gear shaft at that end. This multiple use of the worm gear shaft 42, i.e., receiving power from either the motor-gearbox combination 20 or the hand crank means 54, not only saves cost, but is part of the compact packaging concept of the present embodiment.

Figure 2:
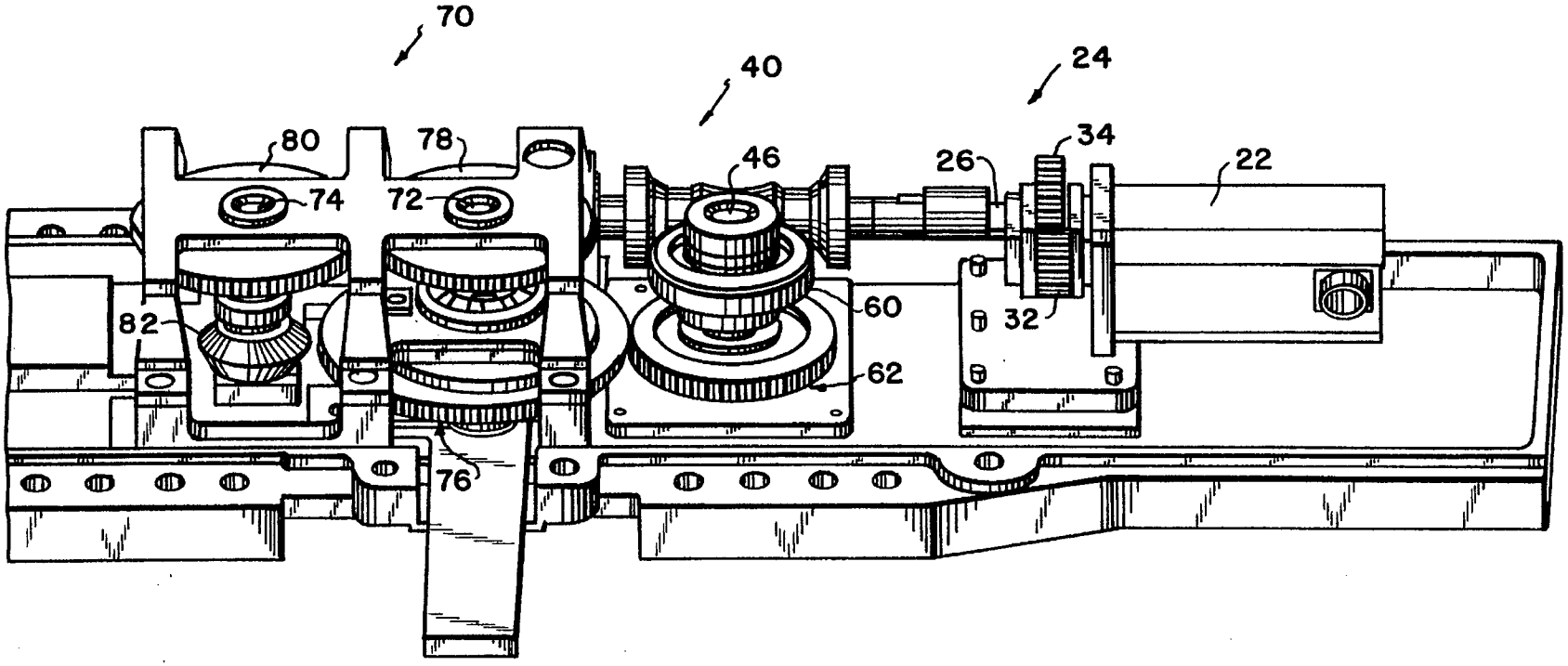
FIG. 2 is another perspective view of the preferred embodiment as shown in FIG. 1, showing the opposite side of the switch machine, wherein covers for the speed reducer gearbox and worm drive gearbox have been omitted.

FIG. 2 shows another view of the main components of the preferred embodiment, viewed from the opposite side, wherein the outer covers 30, 48 of the speed reducer gearbox and the worm drive gearbox have been removed to show their inner components. The inner components of the speed reducer gearbox 24 comprise two engaged circular gears 32, 34 having different diameters. The smaller gear 32 is attached to the motor 22 whereas the larger gear 34 is attached to the output shaft 26 of the speed reducer gearbox 24. As stated above, the output shaft 26 rotates at a speed that is less than, and proportional to, the speed of the motor 22. For example, if the larger gear 34 has a circumference that is twice the circumference of the smaller gear 32, then the speed reducer gearbox would have a 2:1 ratio and the output shaft 26 would rotate at half the speed of the motor 22. Adjusting the speed of the motor 22 through the speed reducer gearbox 24 permits the use of a low profile motor in the preferred embodiment.

Without the outer cover 48 of the worm drive gearbox 40, the inner components of the worm drive gearbox are clearly shown in FIG. 2. In particular, there are two gears that are mounted on the worm drive shaft 46: a worm gear 60 and a drive gear 62. The worm gear shaft 42 engages one side of the worm gear 60 to drive the worm drive shaft 46 and, correspondingly, the drive gear 62. This configuration of the worm drive gearbox 40 not only allows for the multiple use described above but also reduces the speed of the drive gear 62 relative to the worm gear shaft 42. Effectively, worm drive gearbox 40 also acts as a subsequent speed reducer gearbox having a particular ratio, such as 60:1, that follows the first speed reducer gearbox 24.

As shown in FIG. 2, the crank-hand throw drive combination 70 comprises the second and third vertical shafts of the preferred embodiment, the crank shaft 72 and the hand throw shaft 74, respectively. The drive gear 62 rotates about the bottom of the worm drive shaft 46 and meshes with a main drive gear 76 that is mounted on the crank shaft 72. In addition to the main drive gear 76, a crank gear 78 is mounted near the upper end of the crank shaft 72, and meshes with a hand throw gear 80 mounted near the top of the hand throw shaft 74. The upper ends of both the crank shaft 72 and the hand throw shaft 74 are positioned at substantially the same vertical height so that neither shaft increases the height of the switch machine 10 over the other. Near the bottom end of the hand throw shaft 74 is a bevel gear 82, to be described in more detail below.

Figure 3:
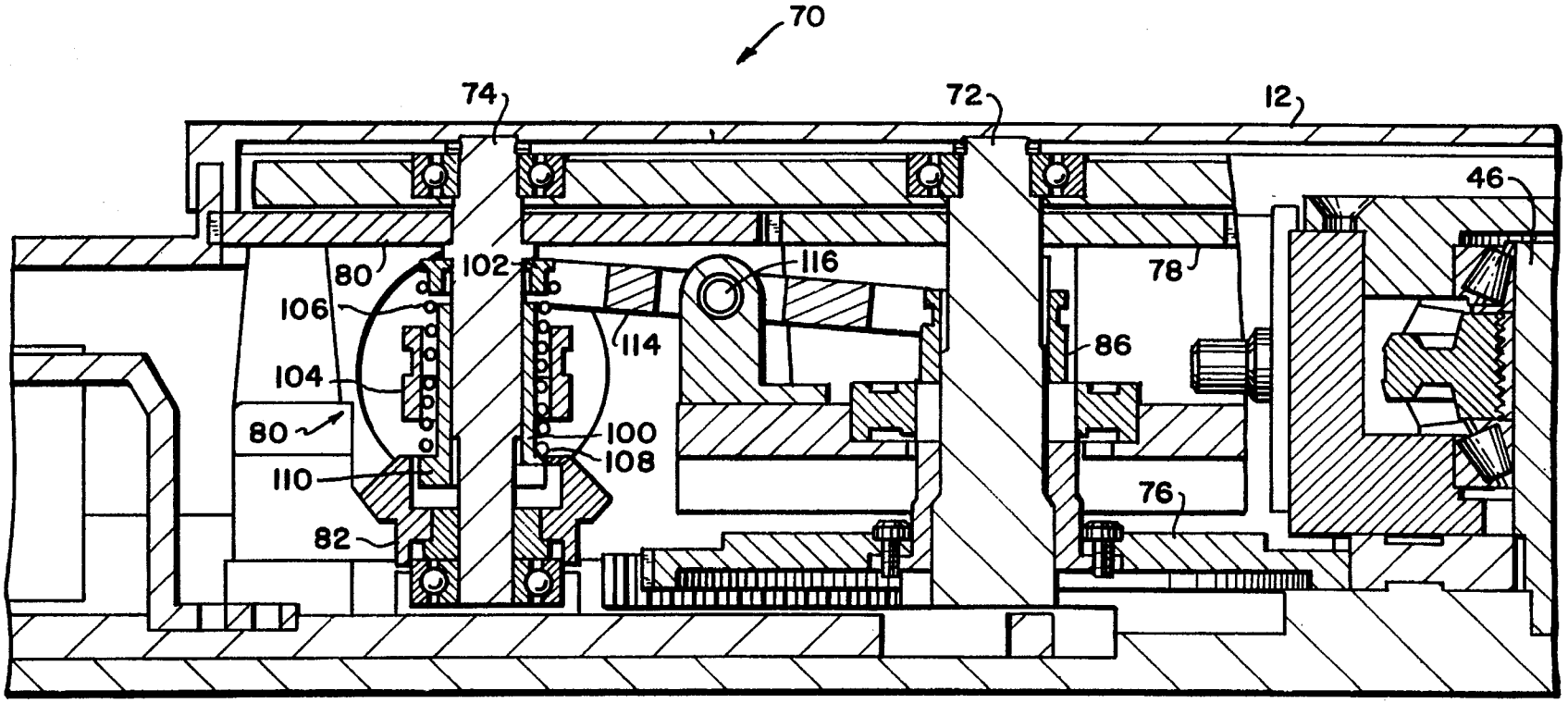
FIG. 3 is a cross-sectional view through the crank shaft and hand throw shaft of the preferred embodiment of FIG. 1.

Referring to FIG. 3, there is shown a cross-sectional view of the crank-hand throw drive combination 70 of the preferred embodiment. By providing a third vertical shaft, i.e., the hand throw shaft 74, that is separate and horizontally adjacent to the crank shaft 72, it is possible to reduce the vertical profile of the switch machine 10 by four (4) or more inches (101.6 millimeters) lower than existing switch machines. As described above, the crank shaft 72 and the hand throw shaft 74 support a crank gear 78 and a hand throw gear 80 near the upper ends and a main drive gear 76 and a bevel gear 82 at the lower ends, respectively. In addition the crank shaft supports a crank sleeve between the crank gear and the main drive gear, and the hand throw shaft 74 supports a hand throw assembly 84 between the hand throw gear 80 and the bevel gear 82.

A crank sleeve 86 is slidably mounted on the crank-shaft 72 so that it may freely slide up and down the crank shaft. This sliding movement is in contrast to the fixed, non-sliding position of the crank gear 78 and the main drive gear 76 on the crank shaft 72. Also, the crank gear 78 and main drive gear 76 are functionally different from each other in that the crank gear rotates with the crank shaft 72 but the main drive gear spins freely around the crank shaft. Similarly, the hand throw assembly 84 is slidably mounted on the hand throw shaft 74, and similar to the crank gear 78, the hand throw gear 80 is fixed to, and rotates with, the hand throw shaft.

Figure 4:
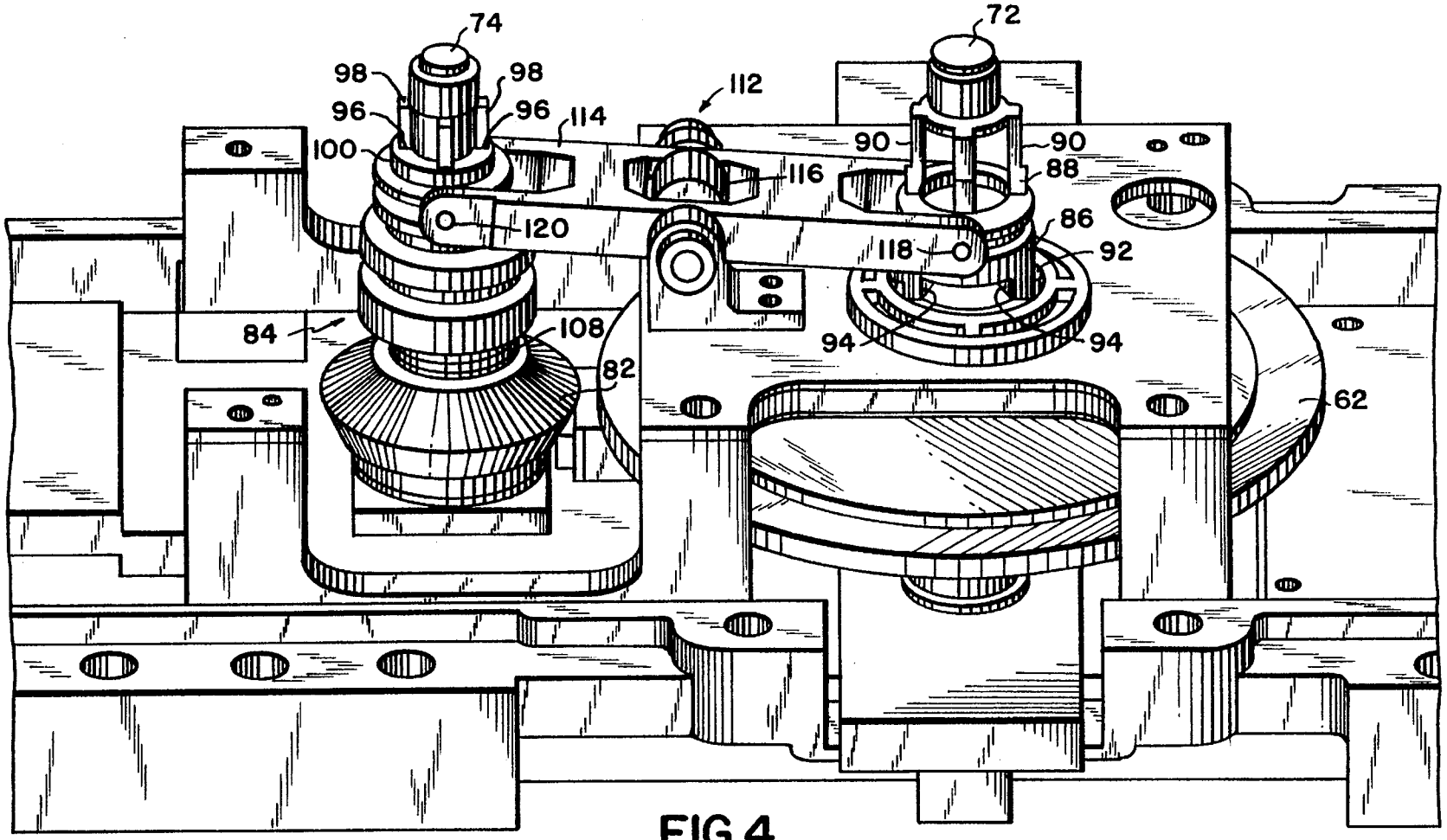
FIG. 4 is a close-up perspective view of the crank shaft and hand throw shaft of the preferred embodiment as shown in FIG. 1, wherein the overhead frame, crank gear and hand throw gear have been omitted.
Figure 5:
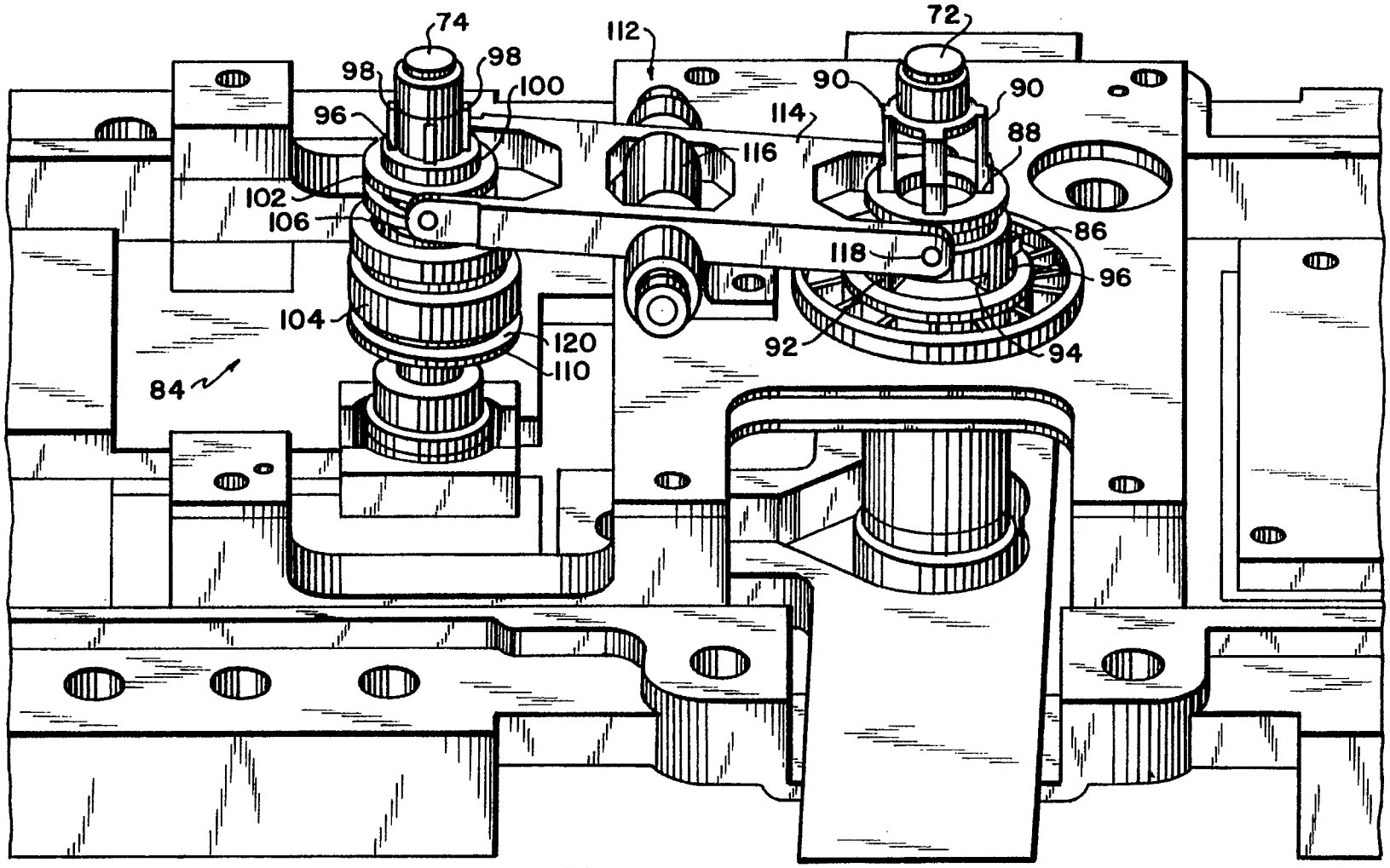
FIG. 5 is another close-up perspective view of the preferred embodiment shown in FIG. 1, wherein the main drive gear and the bevel gear have been omitted.

Referring to FIGS. 4 and 5, the linear movement of the crank sleeve 86 is due to the fact that inner grooves 88 at the inner surface of the crank sleeve follow vertical guides 90 that are located around the outer surface of the crank shaft 72. This connection of the inner grooves 88 of the crank sleeve 86 to the vertical guides 90 of the crank shaft 72 permits the crank sleeve to slide vertically along the crank shaft but rotate in sync with the crank shaft. When the crank sleeve 86 slides down towards the main drive gear 76, teeth 92 along the bottom edge of the crank sleeve interlock with openings 94 along the top portion of the main drive gear. Whereas, normally, the main drive gear 76 rotates freely around the crank shaft 72, when the teeth 92 of the crank sleeve 86 slide down into the openings 94 of the main drive gear 76, the crank sleeve engages the main drive gear to the crank shaft, thus the main drive gear rotates with the crank shaft.

Likewise, the hand throw assembly 84 slides vertically along the longitudinal length of the hand throw shaft 74 due to the inner grooves 96 of the hand throw assembly following the vertical guides 98 of the hand throw shaft. The hand throw assembly 84 comprises an inner sleeve 100, outer sleeve 102, clutch 104, an upper spring 106, and a lower spring 108. The inner sleeve 100 is slidably mounted about the hand throw shaft 74 having a flange 110 at the lower portion for supporting the bottom end of the lower spring 108. The outer sleeve 102 is located about the upper portion of the inner sleeve 100 and is support from below by the upper end of the upper spring 106. The clutch 104 is slidably mounted about the middle portion of the inner sleeve 100 and is supported between the flange 110 and the outer sleeve 102 by the upper and lower springs 106,108.

The bevel gear 82 is situated near the bottom end of the hand throw shaft 74 and rotates freely around the hand throw shaft. The flange 110 of the inner sleeve 100 is designed to engage the bevel gear 82 when the hand throw assembly 84 is lowered into the bevel gear. Thereby, when the flange 110 of the inner sleeve 100 engages the bevel gear 82, the bevel gear engages the hand throw shaft 74 by the hand throw assembly 84, and thus, the bevel gear rotates with the hand throw shaft.

Also shown in FIGS. 4 and 5, a shifter mechanism 112 of the crank-hand throw drive combination 70 includes a linkage arm 114 supported by a fulcrum 116. One end 118 of the linkage arm 114 is pivotally connected to the crank sleeve 86 whereas the other end 120 of the linkage arm is pivotally connected to the outer sleeve 102 of the hand throw assembly 84. Therefore, when the hand throw assembly 84 moves upward, the crank sleeve 86 will move correspondingly downward, rotating the linkage arm 114 clockwise (from the view of FIGS. 4 and 5) around the fulcrum 116. Similarly, when the hand throw assembly 84 moves downward, the crank sleeve 86 will move corresponding upward, rotating the linkage arm 114 counter-clockwise around the fulcrum 116.

Figure 6:
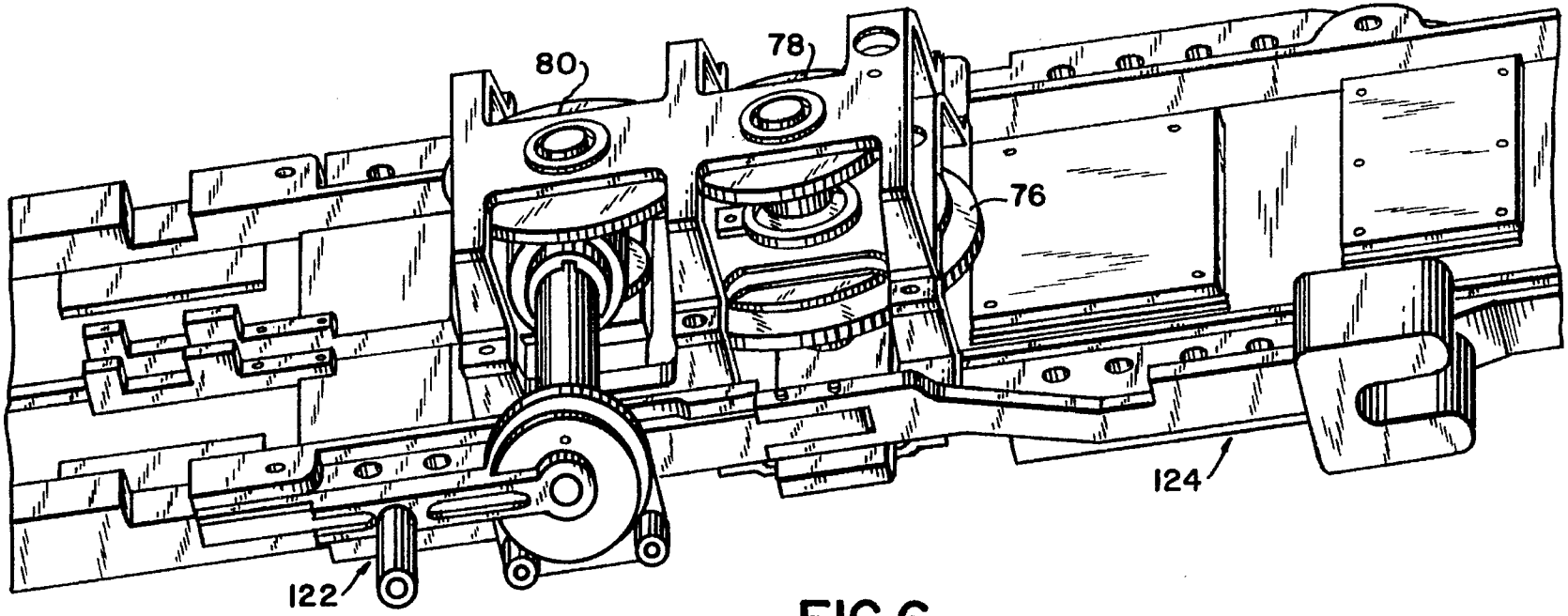
FIG. 6 is perspective view of the preferred embodiment of FIG. 1, additionally showing the hand throw selector and hand throw arm.
Figure 7:
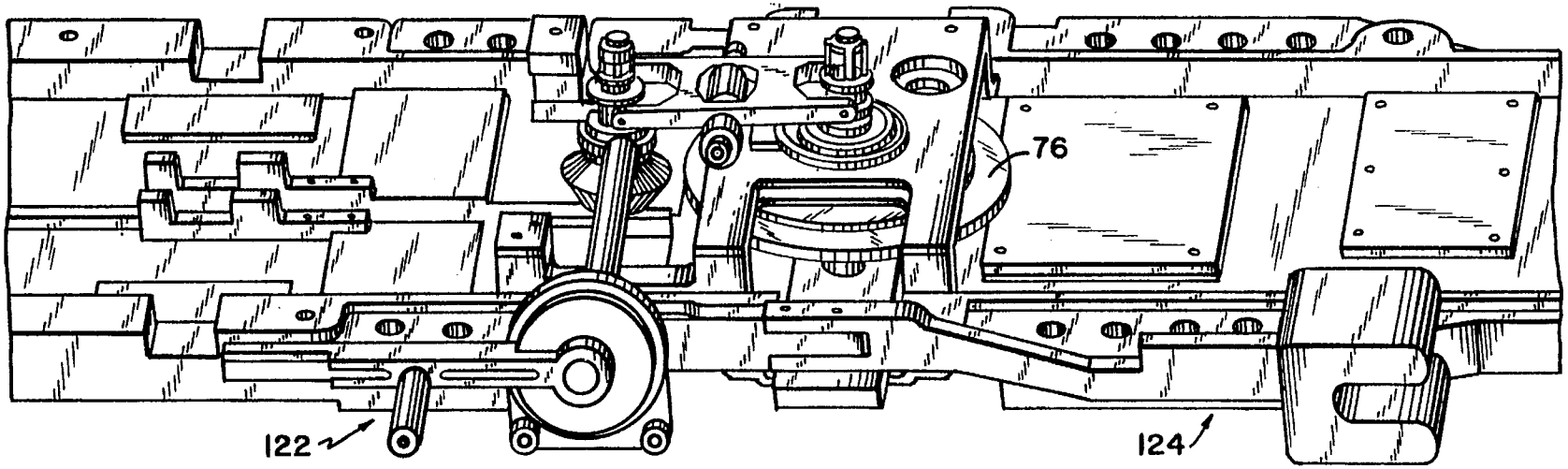
FIG. 7 is another perspective view of the preferred embodiment of FIG. 1, wherein the overhead frame, crank gear and hand throw gear have been omitted.

The main control levers for the hand throw operation are shown in FIGS. 6 and 7, namely a hand throw selector 122 and hand throw arm 124. The hand throw selector 122 selects between one of at least two modes: a power mode and a hand throw mode. When the hand throw selector 122 is in power mode, the hand throw arm 124 is not operational, and the gears 76, 78, 80 for switching the railroad tracks adjacent to the switch machine 10 must be driven by the motor 22 or the hand crank means 54, as described above. When the hand throw selector 122 is in hand throw mode, the hand throw arm 124 may be thrown manually by a human operator, thereby rotating the bevel gear 82, in order to switch railroad tracks using the switch machine 10.

Figure 8:
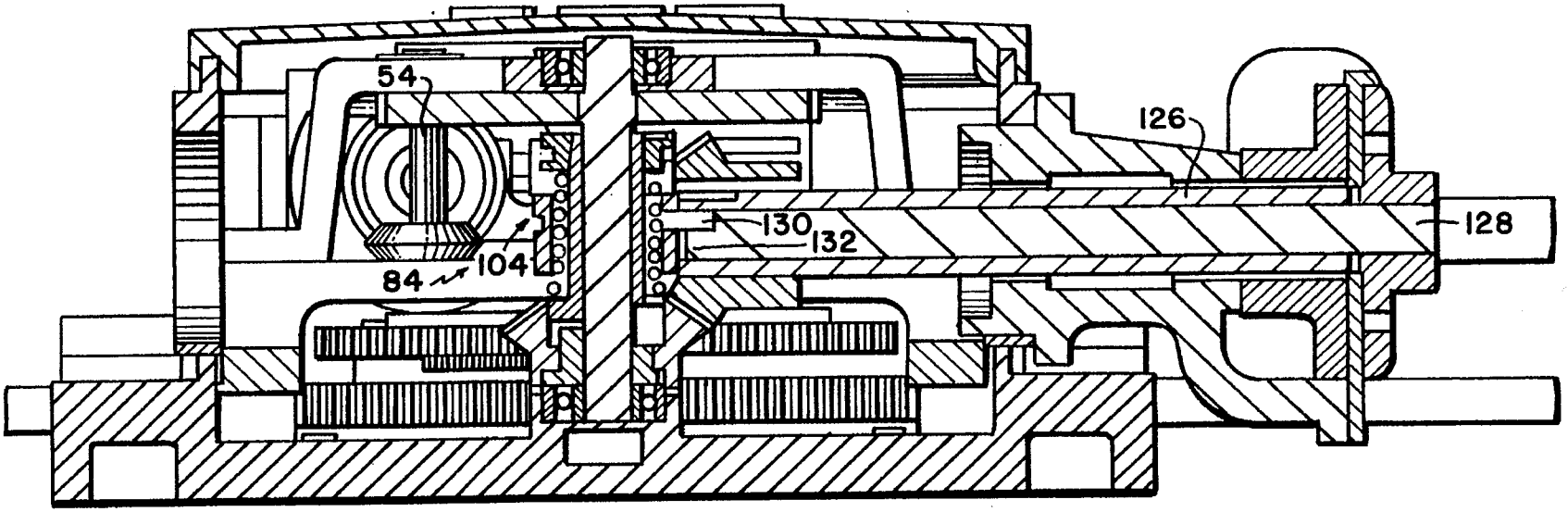
FIG. 8 is a cross-sectional view through the hand throw shaft and hand throw selector of the preferred embodiment of FIG. 1.

Referring to FIG. 8, the manner in which the hand throw selector 122 controls the crank-hand throw drive combination 70 is described in more detail as follows. The hand throw selector 122 comprises a hand throw shaft 126, hand throw lever 128 and eccentric pin 130. The hand throw lever 128 is supported within the hand throw shaft 126 such that it can rotate freely, up to 180 degrees. Thus, turning the hand throw selector 122 from power mode to hand throw mode (or vice versa) effectively turns the hand throw lever 128 "180 degrees" within the hand throw shaft 126. The eccentric pin 130 is positioned at one end 132 of the hand throw lever 128 and offset from the center of the end so that rotating the hand throw lever causes the eccentric pin to move slightly in a vertical motion (as well as horizontal). This vertical motion is transmitted to the clutch 104 of the hand throw assembly 84 through the eccentric pin 130, thus allowing the hand throw selector 122 to selectively move the clutch up and down. In other words, when power mode is selected by the hand throw selector 122, the clutch 104 is moved upward, and when the hand throw mode is selected, the clutch is move downward.

Therefore, referring back to FIG. 3, the overall operation of the crank-hand throw drive combination 70 is described as follows. When power mode is selected by the hand throw selector 122, the clutch 104 of the hand throw assembly 84 is moved upward, thereby forcing the upper spring 106 against the outer sleeve 102 and lifting the flange 110 away from the bevel gear 82. As the outer sleeve 102 moves upward, the linkage arm 114 forces the crank sleeve 86 downward. Before the crank sleeve 86 reaches the main drive gear 76, the main drive gear freely spins about, but does not drive, the crank shaft 72. However, when the linkage arm 114 forces the teeth 92 of the crank sleeve 86 down into the openings 94 of the main drive gear 76, the main drive gear engages the crank shaft 72 through the crank sleeve. Thus, since the main drive gear 76 is indirectly driven by the motor 22 of the motor-gearbox combination 20, the motor is effectively rotating the crank shaft 72 and powers the switch machine 10 to switch the desired railroad tracks.

When the hand throw mode is selected by the hand throw selector 122, the clutch 104 is moved downward, thereby forcing the lower spring 108 against the flange 110 and causing the flange to move downward and to engage the bevel gear 82. Thus, the bevel gear 82 is engaged to the hand throw shaft 74 by the flange 110. When the hand throw arm 124 is thrown by a human operator, the bevel gear 82 rotates, thereby rotating the hand throw shaft 74 and powering the switch machine 10 to switch the desired railroad tracks. At the same time, when the clutch 104 is moved downward, the outer sleeve 102 forces one end 120 of the linkage arm 114, where the outer sleeve is located, downward and forces the other end 118 upward, thus causing the crank sleeve 86 to move upward as well. The crank sleeve 86 moves away from the main drive gear 76 such that the main drive gear is no longer engaged to the crank shaft 72. In summary, the hand throw selector 122, by controlling the clutch 104, causes either the crank sleeve 86 to engage the main drive gear 76 and the flange 110 to disengage the bevel gear 82, or the flange to engage the bevel gear and the crank sleeve to disengage the main drive gear.

Another feature of the preferred embodiment is the utilization of upper and lower springs 106, 108 to support the clutch 104 between the flange 110 and outer sleeve 102 of the hand throw assembly 84. As described above, when power mode is selected by the hand throw selector 122, the crank sleeve will initially attempt to engage the openings of the main drive gear. If the teeth 92 of the crank sleeve 86 are aligned with the openings 94 of the main drive gear 76, then the crank sleeve will immediately engage the main drive gear when power mode is selected. However, if the teeth 92 of the crank sleeve 86 are not aligned with the openings 94 of the main drive gear 76, the main drive gear must turn until the teeth and openings are aligned in order for the crank sleeve to engage the main drive gear. Thus, when the clutch 104 is moved upward and the teeth 92 and openings 94 are not aligned, the upper spring 106 will compress between the clutch 104 and the outer sleeve 102. Therefore, as the main drive gear 76 rotates, the compressed upper spring 106 will force the crank sleeve 86 to engage the main drive gear 76 as soon as the teeth 92 align with the openings 94. Therefore, the upper and lower springs 106, 108 of the hand throw assembly 84 facilitate the operation of the crank sleeve 86 for engaging the main drive gear 76.

The novel concept of the above described preferred embodiment has the following advantages over the existing products found in the field. The multi-function operational capability of the switch machine is maintained, including operation by electric motor, hand cranking or hand throw operation. Also, the low profile machine is only eight inches tall from bottom of the base to top of the cover, and there are no projections below the base that would interfere with existing stock rail ties, concrete pit floors or other equipment installed by railroad owners. In addition, the top of the switch machine has no local vertical projections that could catch projections from passing railroad equipment, thereby, minimizing damage to the switch from external influences. Furthermore, the axial length of the preferred embodiment has not been increased over standards in the industry. Since the various connection points of the switch machine to the railroad tracks are fixed for a given installation, the length from the centerline to either end of the switch machine has been maintained within existing industry limitations.

The invention having been thus described with particular reference to the preferred forms thereof, it will be obvious that various changes and modifications may be made therein without departing from the spirit and scope of the invention as defined in the appended claims.

Wherefore, we claim:

1. A low vertical profile switch machine for switching a position of a railroad track having a mode selector for selecting among a plurality of modes including a power mode and a hand throw mode, comprising:

a crank shaft;

a main drive gear freely rotatable about said crank shaft;

a crank sleeve slidably mounted about said crank shaft for engaging said main drive gear to said crank shaft;

a hand throw shaft positioned adjacent and substantially parallel to said crank shaft;

a bevel gear freely rotatable about said hand throw shaft;

a hand throw assembly slidably mounted about said hand throw shaft for engaging said bevel gear to said hand throw shaft; and a shifter mechanism, having a first end connected to said crank sleeve and a second end connected to said hand throw assembly, for shifting said first and second ends based on the mode selected by the mode selector;

wherein said shifter mechanism shifts said first end to engage said main drive gear and said second end to disengage said bevel gear when the power mode is selected by the mode selector, and wherein said shifter mechanism shifts said second end to engage said bevel gear and disengage said main drive gear when the hand throw mode is selected by the mode selector.

2. The low vertical profile switch machine of claim 1, further comprising a base wherein said crank shaft and said hand throw shaft are positioned adjacent to each other and each is substantially perpendicular to said base.

3. The low vertical profile switch machine of claim 1, wherein said shifter mechanism includes a linkage arm having a fulcrum point so that said first end is positioned at an upper position when said second end is at a lower position and said second end is positioned at an upper position when said first end is at a lower position.

4. The low vertical profile switch machine of claim 1, wherein said crank sleeve includes at least one inner surface groove for allowing said crank sleeve to slide longitudinally along said crank shaft and for preventing said crank sleeve from rotating about said crank shaft.

5. The low vertical profile switch machine of claim 1, wherein said crank sleeve includes an engaging end and a non-engaging end opposite said engaging end.

6. The low vertical profile switch machine of claim 1, wherein said hand throw assembly comprises:

an inner sleeve slidably mounted about said hand throw shaft, having an upper portion, a middle portion, and a lower portion, said lower portion having a flange;

an outer sleeve situated about said upper portion and connected to said second end of said shifter mechanism; and a clutch slidably mounted about said middle portion of said inner sleeve.

7. The low vertical profile switch machine of claim 6, further comprising an upper spring and a lower spring, said upper and lower springs support said clutch between said flange and said outer sleeve.

8. The low vertical profile switch machine of claim 6, wherein the mode selector, located adjacent to said clutch, includes means for controlling said clutch to slide along said inner sleeve.

9. The low vertical profile switch machine of claim 1, further comprising a hand throw arm for driving said bevel gear.

10. A low vertical profile switch machine for switching a position of a railroad track having a mode selector for selecting among a plurality of modes including a power mode and a hand throw mode, comprising:

a motor;

a first gearbox driven by said motor having an input shaft and an output shaft each adapted to rotate, wherein the rotational speed of said input shaft is proportional to the rotational speed of said output shaft;

a gear shaft assembly including a gear shaft having a first input end and a second input end opposite said first input end, wherein said output shaft is coupled to said first input end;

a hand crank means for driving said gear shaft removably attached to said second input end;

a crank shaft positioned a fixed distance from said gear shaft assembly;

a main drive gear freely rotatable about said crank shaft and driven by said gear shaft assembly;

a crank sleeve slidably mounted about said crank shaft for engaging said main drive gear to said crank shaft;

a hand throw shaft positioned adjacent and substantially parallel to said crank shaft;

a bevel gear freely rotatable about said hand throw shaft;

a hand throw assembly slidably mounted about said hand throw shaft for engaging said bevel gear to said hand throw shaft; and a shifter mechanism, having a first end connected to said crank sleeve and a second end connected to said hand throw assembly, for shifting said first and second ends based on the mode selected by the mode selector;

wherein said shifter mechanism shifts said first end to engage said main drive gear and said second end to disengage said bevel gear when the power mode is selected by the mode selector, and said shifter mechanism shifts said second end to engage said bevel gear and disengage said main drive gear when the hand throw mode is selected by the mode selector.

11. A low vertical profile switch machine for switching a position of a railroad track having a mode selector for selecting among a plurality of modes including a power mode and a hand throw mode, comprising:

a base;

a first shaft positioned to rotate on, and substantially perpendicular to, said base;

a drive gear mounted about said first shaft;

a second shaft positioned to rotate on said base and substantially parallel to said first shaft; and a main drive gear freely mounted about said second shaft for engaging said drive gear;

a crank gear mounted about said second shaft above said main drive gear;

a third shaft positioned to rotate on said base and substantially parallel to said second shaft; and a hand throw gear mounted about said third shaft for engaging said crank gear.

12. The low vertical profile switch machine of claim 11, further comprising:

first means for engaging said main drive gear to said crank shaft;

a bevel gear freely rotatable about said hand throw shaft below said hand throw gear; and second means for engaging said bevel gear to said hand throw shaft.

13. The low vertical profile switch machine of claim 12, further comprising a shifter mechanism for operating either said first engaging means or said second engaging means, individually and not together.

* * * * *